US010583959B2

(12) United States Patent
Berry et al.

(10) Patent No.: US 10,583,959 B2
(45) Date of Patent: Mar. 10, 2020

(54) PALLET FOR BAGS

(71) Applicant: Bulk Handling Australia Group Pty Ltd, Sydney (AU)

(72) Inventors: Andrew Berry, Port Melbourne (AU); Colin Waddell, Hawthorne East (AU); Ian Andrew Shaw, Croydon South (AU)

(73) Assignee: BULK HANDLING AUSTRALIA GROUP PTY LTD, Sydney (AU)

( * ) Notice: Subject to any disclaimer, the term of this patent is extended or adjusted under 35 U.S.C. 154(b) by 0 days.

(21) Appl. No.: 14/337,995

(22) Filed: Jul. 22, 2014

(65) Prior Publication Data

US 2014/0331902 A1 Nov. 13, 2014

Related U.S. Application Data

(63) Continuation of application No. 13/635,850, filed as application No. PCT/AU2011/000720 on Jun. 14, 2011, now abandoned.

(30) Foreign Application Priority Data

Jun. 11, 2010 (AU) ..... 2010902576

(51) Int. Cl.
*B65D 19/00* (2006.01)
*B65D 21/02* (2006.01)
*B65D 19/38* (2006.01)

(52) U.S. Cl.
CPC ..... *B65D 19/0038* (2013.01); *B65D 19/004* (2013.01); *B65D 19/0036* (2013.01); *B65D 19/38* (2013.01); *B65D 21/0233* (2013.01); *B65D 2519/00034* (2013.01); *B65D 2519/00069* (2013.01); *B65D 2519/0094* (2013.01); *B65D 2519/00268* (2013.01); *B65D 2519/00288* (2013.01); *B65D 2519/00308* (2013.01); *B65D 2519/00318* (2013.01);
(Continued)

(58) Field of Classification Search
CPC ..... B65D 19/0038; B65D 19/0036; B65D 19/004; B65D 19/38; B65D 21/0233
USPC ..... 108/57.25, 51.11, 53.1, 53.5, 53.3; 206/386; 229/205; 248/346.02
See application file for complete search history.

(56) References Cited

U.S. PATENT DOCUMENTS 2,455,197 A 11/1948 Sullivan
2,544,743 A 3/1951 Vrabcak
(Continued)

FOREIGN PATENT DOCUMENTS

EP 1541477 6/2005

OTHER PUBLICATIONS

International Search Report, PCT/AU2011/000720, dated Dec. 15, 2011, 3 pp.

*Primary Examiner* — Jose V Chen
(74) *Attorney, Agent, or Firm* — Volpe and Koenig, P.C.

(57) ABSTRACT

A pallet moulded from plastics material for supporting a flexible intermediate bulk container. It has a generally planar central panel portion, a pair of parallel inverted open channels extending across the pallet to form a respective pair of open-ended tunnels each tunnel having an upper wall and two side walls, and a pair of edge panel portions generally co-planar with the central panel. An array of raised elongate hump portions bulges upwards from the upper walls of the tunnels, each hump portion extending laterally across an upper wall. The two ends of the hump portions abut respective buttresses which extend up the side walls.

17 Claims, 7 Drawing Sheets

(52) U.S. Cl.
CPC ..... *B65D 2519/00333* (2013.01); *B65D 2519/00338* (2013.01); *B65D 2519/00363* (2013.01); *B65D 2519/00407* (2013.01); *B65D 2519/00412* (2013.01); *B65D 2519/00815* (2013.01)

(56) References Cited

U.S. PATENT DOCUMENTS

| | | | |
|---|---|---|---|
| 2,615,661 | A | 10/1952 | Cushman |
| 3,112,715 | A | 12/1963 | Callahan et al. |
| 3,120,825 | A | 2/1964 | Johnson |
| 3,135,228 | A | 6/1964 | Fleming et al. |
| 3,167,341 | A | 1/1965 | Higgins |
| 3,187,688 | A | 6/1965 | Kreilick |
| 3,272,158 | A | 9/1966 | Barnum |
| 3,759,194 | A | 9/1973 | Fujii et al. |
| 4,145,974 | A | 3/1979 | Fleming et al. |
| 6,928,933 | B2 | 8/2005 | Grau |
| D533,328 | S | 12/2006 | Wake |
| 7,607,628 | B2 | 10/2009 | Elder et al. |

PALLET FOR BAGS

CROSS REFERENCE TO RELATED APPLICATION

This application is a continuation of U.S. patent application Ser. No. 13/635,850, filed Feb. 13, 2013, which was filed as a 371 National Stage of International Patent Application No. PCT/AU2011/00720, filed Jun. 14, 2011 and claims the benefit of priority from Australian Patent Application No. 2010902576, filed on Jun. 11, 2010, all of which are incorporated by reference as if fully set forth.

BACKGROUND AND SUMMARY OF INVENTION

This invention concerns the construction and use of pallets, and is particularly, though not exclusively, directed to pallets suitable for use to support and transport flexible intermediate bulk containers (FIBCs).

FIBCs are sack-like storage and transport containers commonly used for bulk dry materials. Typically they are sized to fit on and occupy most of a standard 1.1 m×1.1 m shipping/storage pallet and hold about one cubic metre of material. When FIBCs are stacked directly one on top of another it is difficult to slip forklift tines under the upper FIBC. For this reason a pallet is often placed between stacked FIBCs. However conventional pallets are expensive and there is a need for a cheaper form of pallet that can serve the purpose. Many different configurations of plastic pallets have been proposed but it has proven difficult to achieve at the same time the joint goals of light weight and low cost while also providing sufficient strength to prevent adverse collapse or distortion of the pallet in use. The present invention is intended to provide a pallet which has an improved balance of performance in the desired characteristics.

Accordingly, in one aspect the invention provides a pallet moulded from plastics material and adapted for supporting and lifting a flexible intermediate bulk container, said pallet comprising:

- a generally planar central panel portion;
- a pair of parallel inverted open channels extending across the pallet and rising upwards from the plane of the central panel portion to form a respective pair of open-ended tunnels, each said tunnel having an upper wall and two side walls and each tunnel extending fully between two opposite ends of the pallet; and
- a pair of edge panel portions generally co-planar with said central panel;

each said tunnel having:

- a first of said side walls adjoining a corresponding inboard edge of said central panel, and
- the second of said side walls adjoining an inboard edge of a corresponding said edge panel;

wherein:

- an array of raised elongate first hump portions bulges upwards from each said upper wall of the tunnels, each said first hump portion extending laterally across a respective said upper wall;
- a first end of each said first hump portion abuts a first end of a respective first buttress which extends up said first side wall; and
- a second end of each said first hump portion abuts a first end of a respective second buttress which extends up said second side wall.

Preferably a first selection of said buttresses rise above the height of their abutting said first hump portions. Preferably a second selection of said first hump portion and associated said first buttress and said second buttress are located at each end of each said tunnel, and said humps in said second selection rise to substantially the same height as the buttresses in said second selection.

Preferably:

- an array of raised elongate second hump portions is moulded into each said edge panel,
- each said second hump portion extends from a said inboard edge of said edge panel to an outer edge of said edge panel, and transverse to the longitudinal direction of said tunnels, and
- each said second buttress abuts the second end of said first hump portion.

In another aspect the invention provides a pallet moulded from plastics material and adapted for supporting and lifting a flexible intermediate bulk container, said pallet comprising:

- a generally planar central panel portion;
- a pair of parallel inverted open channels extending across the pallet and rising upwards from the plane of the central panel portion to form a respective pair of tunnels, each said tunnel having an upper wall and two side walls; and
- a pair of edge panel portions generally co-planar with said central panel; each said tunnel having:
- a first of said side walls adjoining a corresponding inboard edge of said central panel, and
- the second of said side walls adjoining an inboard edge of a corresponding said edge panel;

wherein:

- an array of raised elongate first hump portions bulges upwards from each said upper wall of the tunnels, each said first hump portion extending laterally across a respective said upper wall;
- an array of raised elongate second hump portions bulges upwards from each said edge panel, each said second hump portion extending longitudinally from a said inboard edge of said edge panel to an outer edge of said edge panel, and extending transverse to the longitudinal direction of said tunnels;
- an array of raised elongate third hump portions bulges upwards from said central panel, each said third hump portion extending longitudinally from one said inboard edge of the central panel to the other said inboard edge of the central panel, and extending transverse to the longitudinal direction of said tunnels;
- each end of each said third hump portion is linked to its respective said tunnel by a first buttress which extends up a said first side wall to where the first buttress links to a corresponding said first hump portion; and
- an inboard end of each said second reinforcing hump is linked to its respective said tunnel by a second buttress which extends up a said second side wall to where the second buttress links to a corresponding said first hump portion.

In a further aspect the invention provides a pallet moulded from plastics material and adapted for supporting and lifting a flexible intermediate bulk container, said pallet comprising:

- a generally planar central panel portion;
- a first pair of parallel inverted open channels extending across the pallet in a first direction and rising upwards from the plane of said central panel portion to form a respective first pair of tunnels, a second pair of parallel inverted open channels extending across the pallet in a second direction at right angles to said first direction and rising upwards from said plane of said central panel portion to form a respective second pair of tunnels; and two pairs of edge panel portions generally co-planar with said central panel portion;

each said tunnel having:

an upper wall and two side walls, a first of said side walls adjoining a corresponding inboard edge of said central panel, and a second of said side walls adjoining an inboard edge of a corresponding said edge panel;

wherein:

a first array of raised elongate first reinforcing humps bulges upwards from said central panel, each said first hump extending longitudinally from one said inboard edge of the central panel to the other said inboard edge of the central panel, and extending transverse to the longitudinal direction of said tunnels;

a second array of raised elongate second reinforcing humps bulges upwards from each said edge panel, each said second reinforcing hump extending longitudinally from a said inboard edge of said edge panel to an outer edge of the edge panel, and extending transverse to the longitudinal direction of said tunnels;

a third array of raised elongate third reinforcing humps bulges upwards from each said upper wall of the tunnels, each said third hump extending laterally across a respective said upper wall;

each end of each said first reinforcing hump is linked to its respective said tunnel by a first buttress which extends up a first said side wall to a corresponding said third reinforcing hump; and an inboard end of each said second reinforcing hump is linked to its respective said tunnel by a second buttress which extends up a second said side wall to a corresponding said third reinforcing hump.

Preferably said buttresses are hollow and fully open along their length to the underside of the pallet.

Preferably the nominal wall thicknesses of the plastics material in the central panel portion, the edge panel portions and the tunnels differ by no more than 50% of their smallest nominal thickness. More preferably all the nominal wall thicknesses of the plastics material in the central panel, the edge panels and the tunnels are substantially the same.

Preferably the pallet is stackable in a nested stack of identical pallets wherein the addition of each said pallet to the stack increases the height of the stack by no more than 30% of the height of a freestanding individual said pallet. More preferably the addition of each said pallet to the stack increases the height of the stack by only about 25% of the height of a freestanding individual said pallet.

Preferably a plurality of said buttresses each incorporate a step comprising a substantially horizontal platform, each step providing an engagement means which extends to level with the lower surface of the adjacent portion of the respective central panel or edge panel whereby, when like said panels are stacked nested together, load from an upper said pallet may be transmitted through the engagement means of said upper pallet to the underlying platform of a said pallet nested immediately below said upper pallet. More preferably each said step is hollow except for a rib which extends across the buttress and from the underside of said platform to level with the lower surface of the adjacent portion of the respective central panel or edge panel whereby, when like said panels are nested together, load from an upper said pallet may be transmitted through the web of the upper pallet to the underlying platform of said pallet nested immediately below said upper pallet.

A fourth array of raised elongate fourth reinforcing humps may bulge upwards from the outer edge of each said edge panel, a fifth array of raised curved fifth reinforcing humps bulge upwards from the upper wall of each corner panel, and said elongate reinforcing humps with buttresses be connected to provide each end of each said reinforcing hump is linked to its respective said tunnel by a buttress which extends up the side wall to a corresponding reinforcing hump and provides a continuous reinforcing hump around the perimeter of the pallet. Preferably said first buttresses are connected to the perimeter ring by means of the first hump portions on the panels.

In a further aspect the invention provides a method of transporting a flexible intermediate bulk container at least substantially filled with bulk material, said method comprising placing the container on a pallet according to any one of the preceding claims, engaging the tines of a forklift apparatus with said tunnels and lifting the pallet by raising the forklift tines.

DESCRIPTION OF EXAMPLES OF THE INVENTION AND THE PREFERRED EMBODIMENT

In order that the invention may be more fully understood there will now be described, by way of example only, preferred embodiments and other elements of the invention with reference to the accompanying drawings where:

Figure 1:
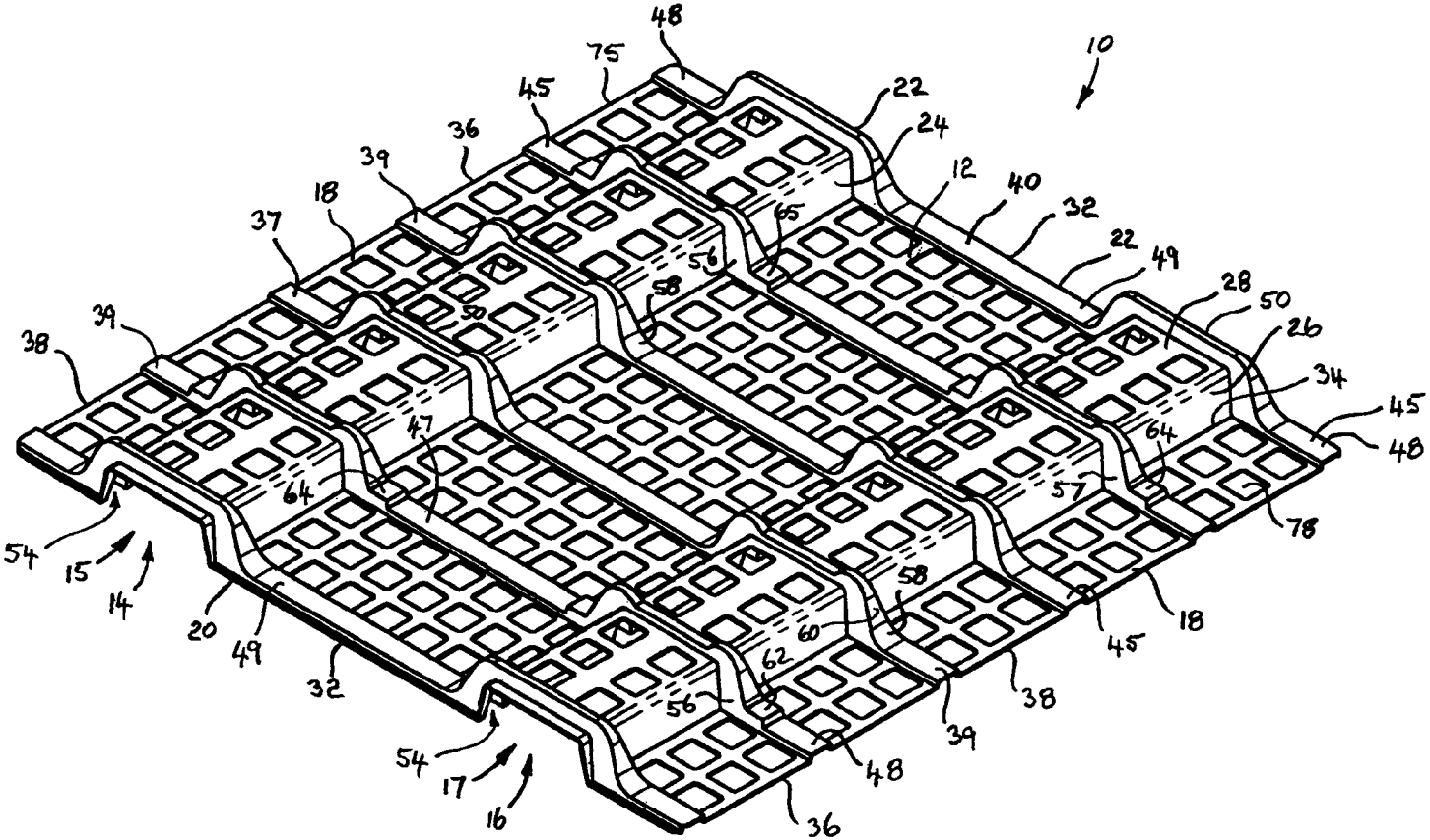
FIG. 1 is an isometric view looking down upon a pallet according to a first embodiment of the invention.
Figure 2:
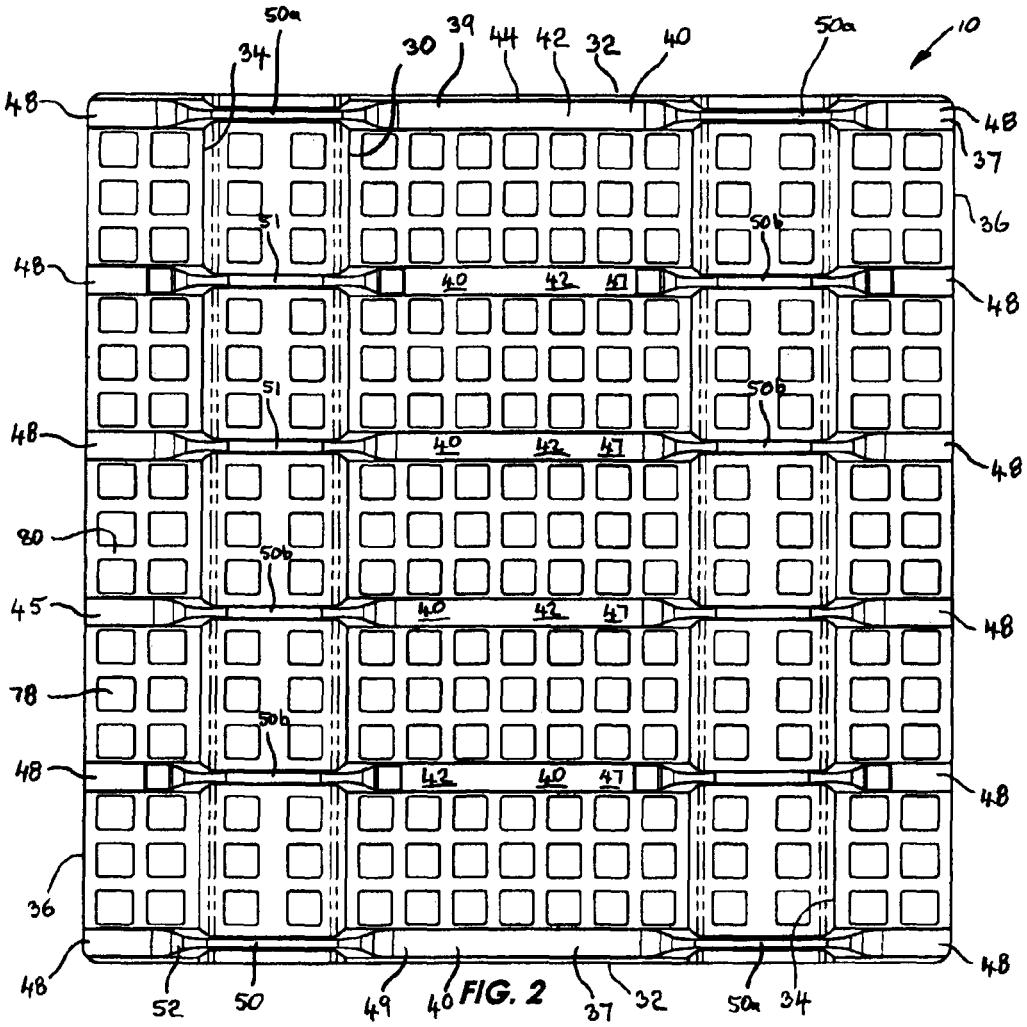
FIG. 2 is a plan view looking down on the pallet shown in FIG. 1.
Figure 3:
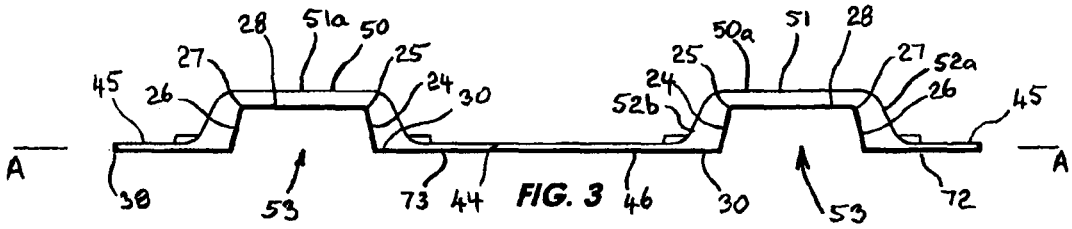
FIG. 3 is an end view of the pallet shown in FIG. 1.
Figure 4:
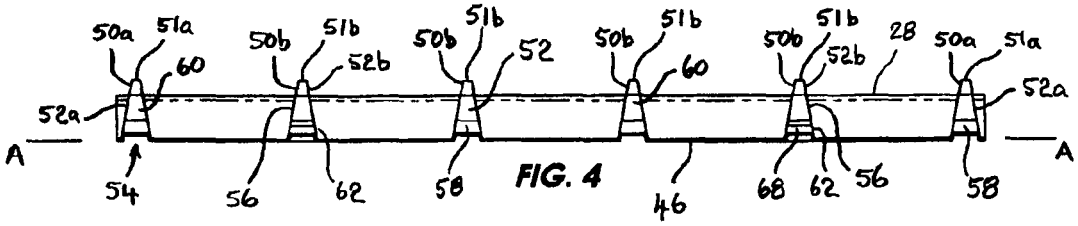
FIG. 4 is a side view of the pallet shown in FIG. 1.
Figure 5:
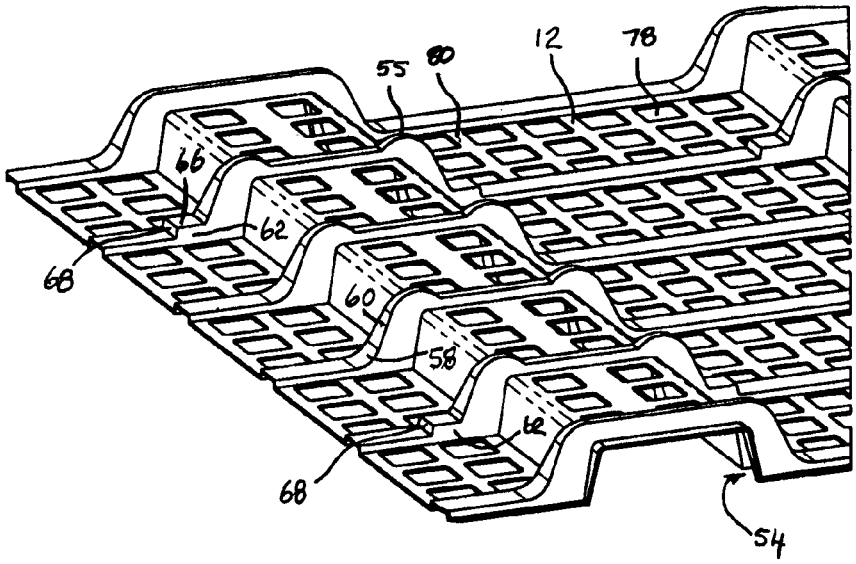
FIG. 5 is another isometric view of portion of the pallet shown in FIG. 1.

The pallet 10 shown in FIGS. 1 to 5 is injection moulded from a suitable engineering plastics material (such as HDPE) and has a generally thin wall construction. The pallet 10 has a generally planar central panel 12, a pair of parallel inverted channels 14 and 16 extending across the pallet 10, and a pair of edge panels 18 on the opposite side of each channel to where the central panel 12 is.

Each channel 14 and 16 forms an open-bottomed tunnel 15 and 17 respectively which rises from the plane A-A (indicated on FIGS. 3 and 4) shared by the central panel 12 and the edge panels 18. Each tunnel extends from one end 20 of the pallet to the other end 22. Each tunnel 15 and 17 has two side walls, these being an inboard side wall 24 and an outboard side wall 26, and an upper wall 28 which extends between the tops 25 and 27 respectively of the inboard and outboard side walls.

The tunnels 15 and 17 are sized both in width and depth to accommodate the tines of a forklift truck. The tunnels act as pockets for the tines. The pallet 10 is approximately 1.1 m square and the tunnels are spaced 640 mm centre to centre. On its underside, each tunnel is approximately 200 mm wide and 55 mm deep.

The inboard side wall 24 of each tunnel rises from a respective inboard edge 30 of the central panel 12. The other two edges 32 of the central panel form portion of respective ends 20 and 22 of the pallet. The outboard side wall 26 of each tunnel rises from an inboard edge 34 of a respective edge panel 18. Opposite said inboard edge 34, the outboard edge 36 of the edge panel 18 forms a full side edge 38 of the pallet 10.

To assist rigidity of the pallet, six elongate composite humps 37 extend across the pallet transverse to the longitudinal direction of the tunnels 15 and 17. Each composite hump 37 extends across the central panel 12, the edge panels 18, the side walls 24 and 26 and the upper walls 28 of the tunnels. Each hump is formed as an elongate bulge protruding from the surrounding surfaces of the pallet.

An array 39 of six raised elongate central hump portions 40 is moulded into the central panel 12. Each central hump portion 40 forms a central portion of a respective composite hump 37. The term "composite hump" refers to a hump which comprises a linked series of hump portions which abut each other end to end.

The central hump portions 40 in the array 39 are parallel to each other and have the form of a raised ridge having a generally flat upper face 42 and near-vertical side walls 44. Each central hump portion 40 extends laterally across the central panel 12 from one inboard edge 30 of the central panel to the other inboard edge 30 of the central panel.

Six raised elongate edge panel hump portions 48 are moulded into each edge panel 18 and are longitudinally aligned with the central hump portions 40 on the central panel. Each edge panel hump portion 48 extends across its respective edge panel 18 from its inboard edge 34 to its outboard edge 36.

The hump portions 40 and 48 on the central panel 12 and edge panels 18 respectively extend transverse to the longitudinal direction of the tunnels 15. The hump portions 40 and 48 are formed as thin walled inverted channels open for their full length to the underside 46 of the pallet. The hump portions 40 and 48 are approximately 40 mm wide and rise 10 mm above their respective surrounding panels.

The tunnel-top hump portions 50, positioned on the upper wall 28 of the tunnels, are aligned vertically (but offset horizontally) with corresponding central hump portions 40 on the central panel, and corresponding edge panel hump portions 48 on the edge panels. The tunnel-top hump portions 50 are narrower (about half the width) compared with the central hump portions 40 on the central panel and the edge panel hump portions 48 on the edge panels. Each tunnel-top hump portion 50 is linked to aligned corresponding hump portions on the central panel and edge panels by means of buttresses 52 which extend up the side walls 24 and 26 of the tunnels. The buttresses 52 are thin-walled and have open bottoms 54.

Each composite hump 37 comprises one central hump portion 40 in the central panel, two edge panel hump portions 48 on the edge panels, two tunnel-top hump portions 50 on the upper walls and four buttresses 52. The hump portions are linked or joined end to end in the relevant order. Each hump portion is connected directly to its adjoining hump portion or portions in a manner that smoothly continues or blends the walls of the hump portions. The hump portions can be considered to abut end to end although the exact position of that abutment may be unclear due to the smooth blending of the walls of the various features concerned.

The central panel 12, edge panels 18 and upper walls 28 of tunnels are thus each divided into five flat horizontal surfaces separated by inboard humps 47. Edge humps 49 extend along respective edges at each end 20 and 22 of the pallet.

The edge buttresses 52*a* and tunnel-top hump portions 50*a* of the edge humps 49 differ from the inboard buttresses 52*b* and tunnel-top hump portions 50*b* of the inboard humps 47. For the inboard humps 47, the top 55 of each inboard buttress 52*b* extends in an arch up to above the height of the upper face 51*b* of the associated inboard tunnel-top hump portion 50*b*. This provides additional strength to resist flattening of the tunnels when the pallet is loaded. For the edge humps 49 the upper face 51*a* of the edge tunnel-top hump portions 50*a* is raised higher than for inboard tunnel-top hump portions 50*b* to provide increased resistance to flattening of the tunnels at the ends 22 when under load. Although the edge buttresses 52*a* of the edge humps 49 extend to the same height as the buttresses 50*b* on the inboard humps 47, the edge hump portions 50*a* also extend to the height of the edge buttresses 52*a*, so there is no arching over at the top of the edge buttresses 52*a*.

Figure 6:
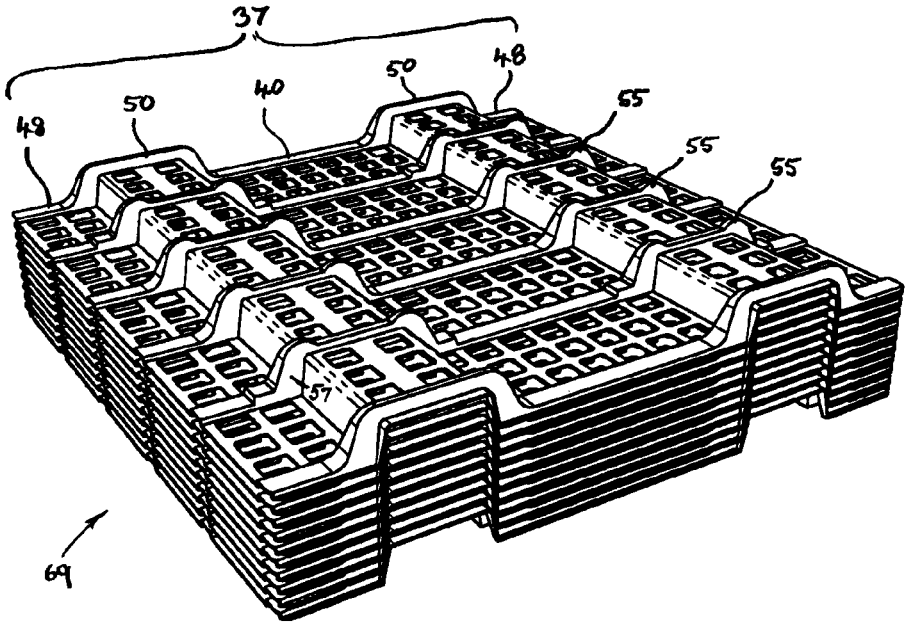
FIG. 6 is a perspective view of a stack of ten pallets, each pallet being as shown in FIG. 1.
Figure 7:
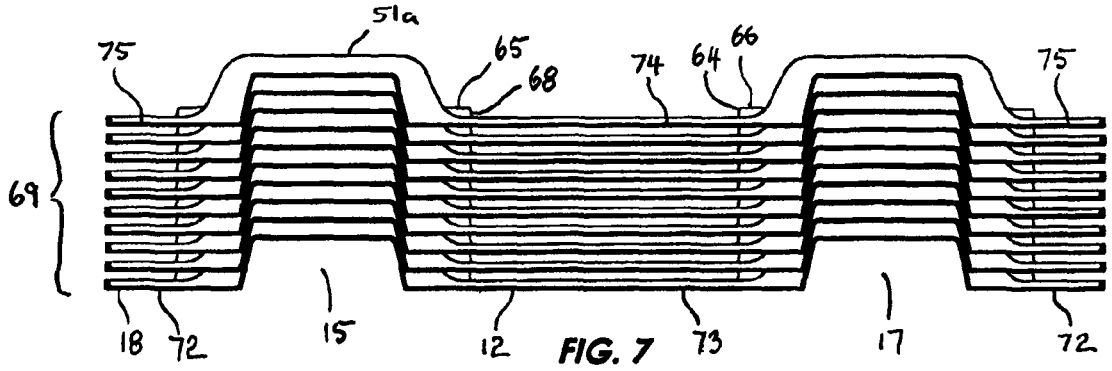
FIG. 7 is an end view of the stack shown in FIG. 6.
Figure 8:
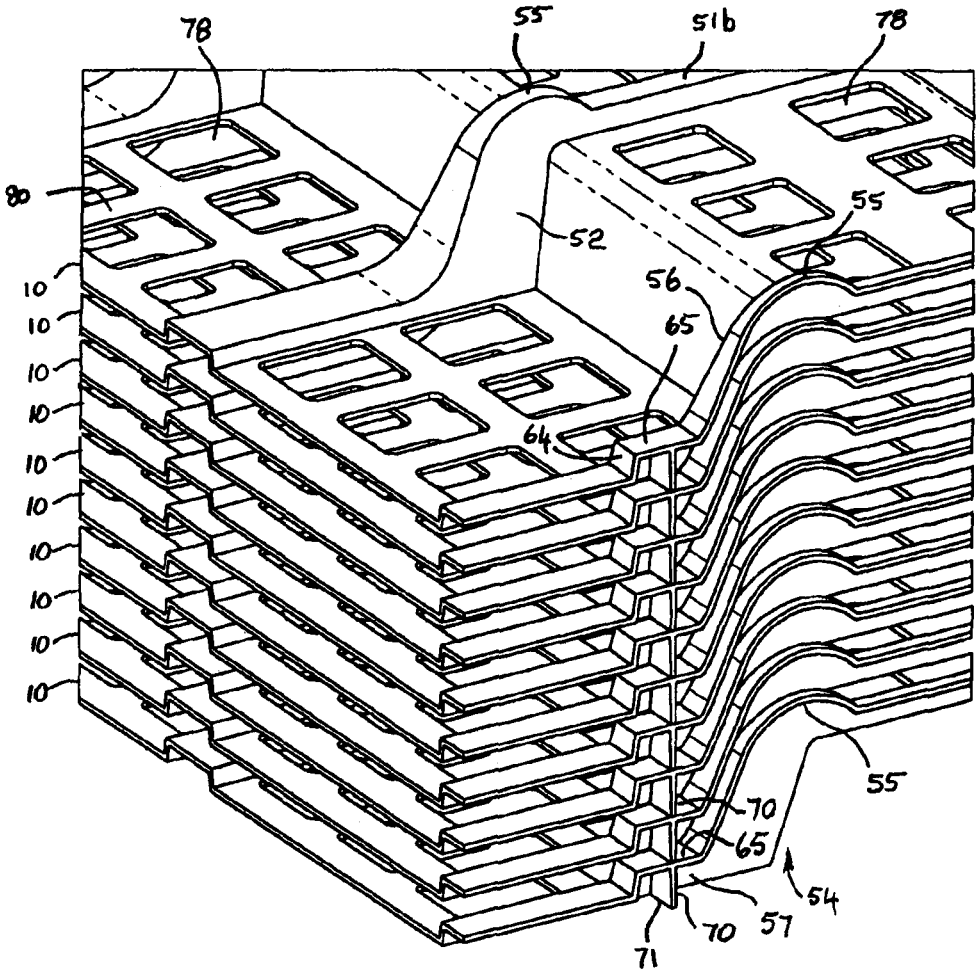
FIG. 8 is a cutaway detail view of portion of the stack shown in FIG. 6.

The open bottoms 53 and 54 on the tunnels 15 and 17 and buttresses 52 permit the pallets 10 to nest into each other when stacked as shown in FIGS. 6 to 8. Nested pallets are prevented from jamming together by the configuration of eight of the buttresses 52. The eight buttresses in that selection are referred to herein as support buttresses 56. The support buttresses 56 are located next to the edge buttresses 52*a* and their configuration is different to the other buttresses. While the lower portion 58 of the upper faces 60 of most of the buttresses are curved to blend smoothly into the upper faces 42 and 45 of the hump portions 40 and 48 respectively, the lower portion 62 of the support buttresses 56 incorporate a step 64 having a horizontal platform portion 66 which ends at an end wall portion 68 which drops to the associated hump portion 40 or 48.

The step 64 is a relatively thin walled moulded hollow portion formed integrally with the remainder of the pallet. Within the hollow (ie on the underside of) each step 64 is a rib 70 having the form of a vertically aligned planar web extending down from the under-surface of the step 64, and extending from side wall 57 to side wall 57 of the support buttress 56 and approximately centrally to the step 64. The bottom edge 71 of the rib 70 is aligned with the lower surface 72 or 73 of the adjacent portion of respective panel 18 or 12. As can be seen particularly in the cutaway portion of FIG. 8, when such pallets are stacked upon each other, the bottom edge 71 of each rib 70 bears against the upper surface 65 of a step 64 on the underlying pallet, so successively underlying ribs 70 form a structural column wherein a load is transferred to the corresponding rib 70 below. This means that when pallets 10 are stacked in a nested configuration on each other on a floor and a load is placed on the upper pallet, the weight of that load is transmitted at least in part through to the floor by way of the column of vertically aligned ribs 70.

The horizontal portions 74 and 75 of the central panel 12 and edge panels 18 respectively and the upper walls 28 of the tunnels are each formed as an open square lattice. The holes 78 in the central panel 12 and upper walls 28 of the tunnels are 42.5 mm square and the holes 78 in the edge panels 18 are 42.5×47.5 mm. The lattice configuration provides a lighter pallet because it requires less material without an unacceptable reduction in strength. The strap portions of the central panel 12 and edge panels 18 are 2.5 mm thick, while the side walls 24 and 26 of each tunnel, and the strap portions 80 on the upper walls 28, all have a 3.5 mm thickness (ie 40% thicker material) for additional strength. A pallet 10 as described above weighs approximately 3.3 kg. It is preferable for the wall thickness of the portions of the pallet to not differ by more than 50% of their smallest nominal thickness.

Each pallet 10 is approximately 80 mm high measured from the lower surfaces 72 and 73 to the upper faces 51. When nested in a stack 69 of ten pallets as shown in FIG. 7, the stack 69 is approximately 260 mm high overall. Each pallet added to the stack increases the height of the stack by only 20 mm, which increase is 25% of the height of a freestanding individual pallet 10. This particularly compact form of stacking is an advantage pallet 10 over prior art pallets of equivalent load carrying capacity.

It will be appreciated that the pallets 10 can be nested as described only if there is no base or lower wall in the tunnels 15 and 17. If a channel forming a tunnel had some form of reinforcing strap or wall spanning even part of it (i.e. the channel was not open) the nesting could not be achieved without also incorporating major weakening discontinuities in the upper and side walls of the tunnels.

Any prior art pallet which may have had forklift tine accepting tunnels of this type, ie tunnels without a base, would have a tendency for the tunnels to flatten when an FIBC, typically weighing up to 1 tonne, is placed on it. However in the case of the embodiment described above the raised hump portions 40, 48 and 50 and the buttresses 52 provide sufficient strength and resistance to bending that the tunnels can remain open for forklift access with loads on the pallets of up to 2 tonne. Thus FIBCs supported by pallets 10 may be stacked two-high and still allow for a forklift to lift both at once. If additional carrying capacity is required, two pallets may be nested together in order to provide increased stiffness.

The raised hump portions 40, 48 and 50 and the arched tops 55 of the buttresses provide protrusions which assist to prevent slipping of an FIBC on the pallet 10.

Figure 9:
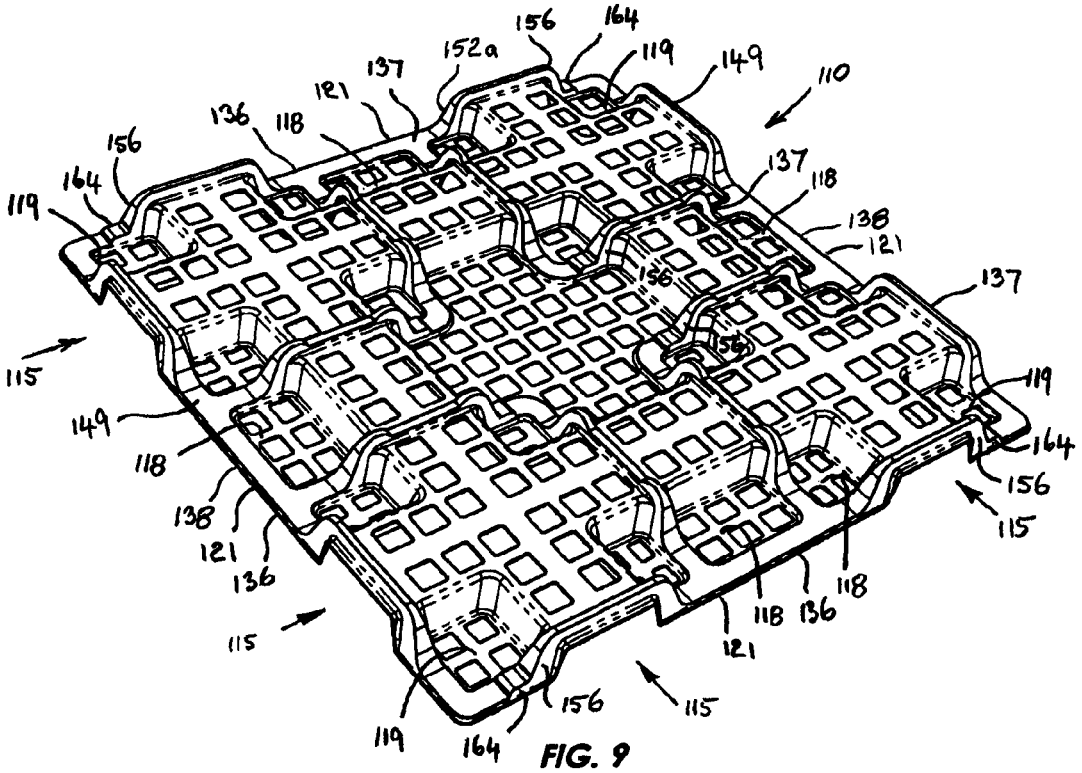
FIG. 9 is an isometric view of a pallet according to a second embodiment of the invention.
Figure 10:
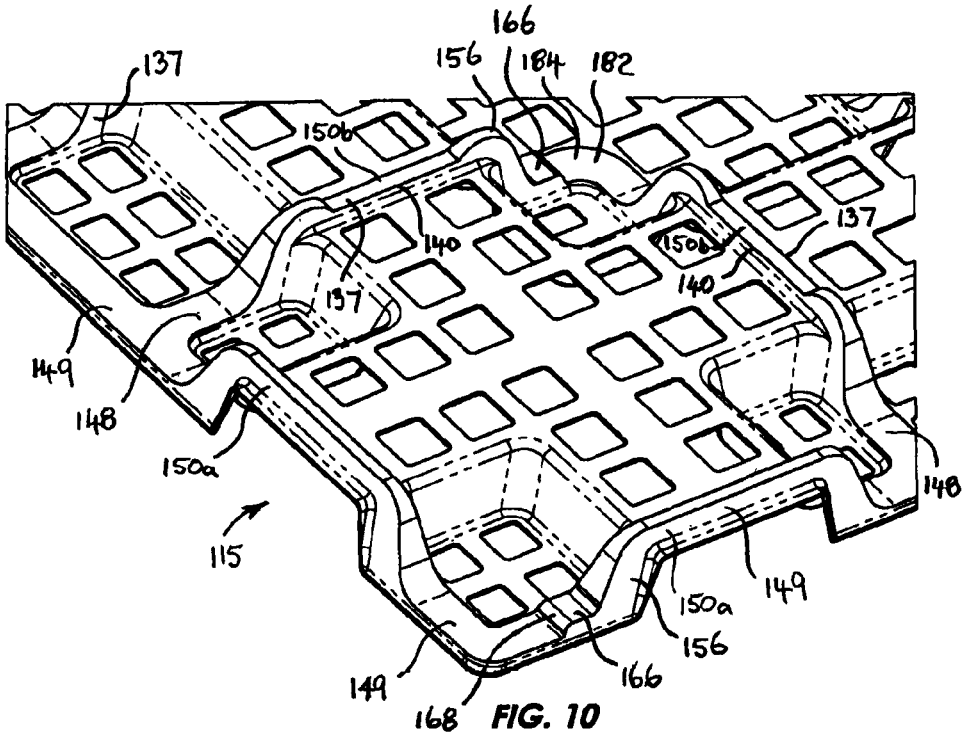
FIG. 10 is an enlarged isometric view of portion of the pallet shown in FIG. 9.
Figure 11:
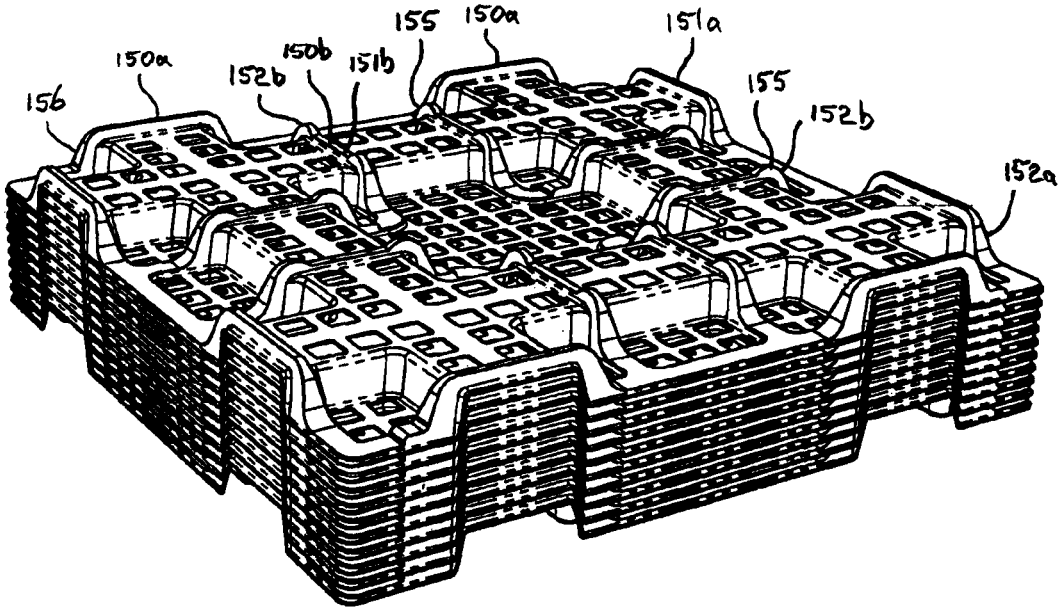
FIG. 11 is a perspective view of a stack of ten pallets, each pallet being as shown in FIG. 9.
Figure 12:
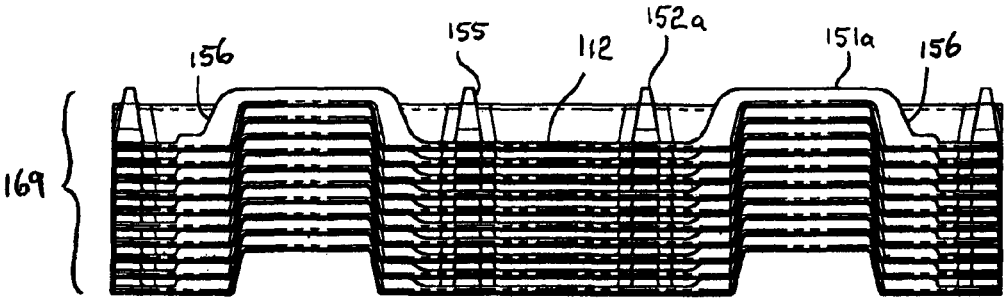
FIG. 12 is an end view of the stack shown in FIG. 11.
Figure 13:
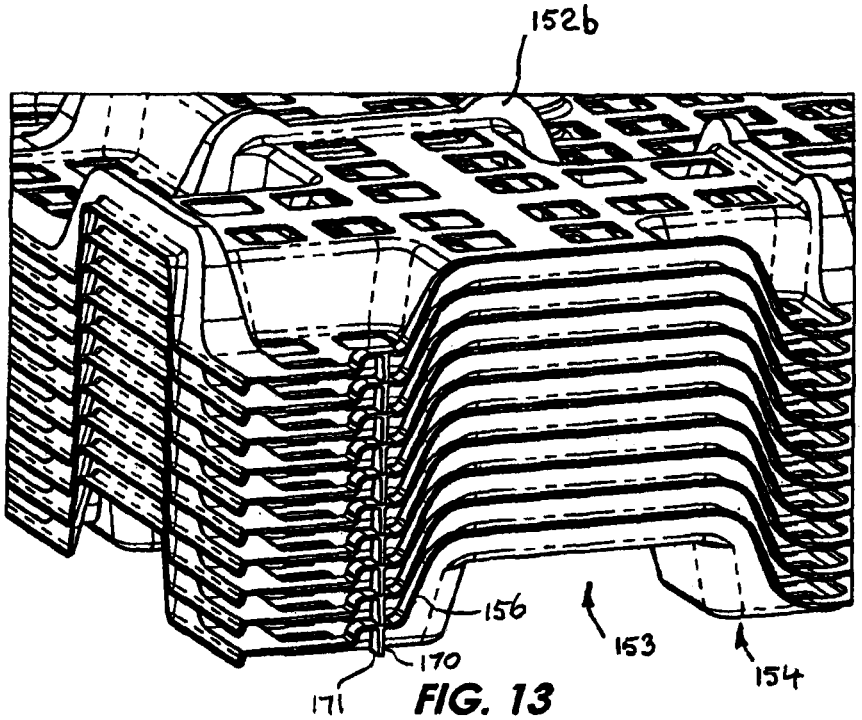
FIG. 13 is a detail cutaway view of portion of the stack shown in FIG. 11.

The pallet 110 shown in FIGS. 9 and 10, and stacked in FIGS. 11 to 13, has many features in common with pallet 10 although some of the features are modified.

The pallet 110 has two pairs of tunnels 115 of the general type as tunnels 15 described above. Each pair of tunnels 115 is aligned at right angles to the other pair. A forklift is thus able to lift the pallet 110 from any one of four directions. In contrast the pallet 10 described earlier can be lifted only from either of its two ends.

The tunnels 115 separate the remaining surface of the pallet into nine main regions which are generally planar apart from humps bulging upwards therefrom. The nine regions are a central panel 112, four edge panels 118 and four corner panels 119. The central panel 112 is bounded by all four tunnels 115. The edge panels 118 are bounded by three tunnels and a respective edge 121 of the pallet 110. The corner panels are bounded by two tunnels and two edges 121 of the pallet.

The pallet 110 has linked hump portions bulging upwards from the top surface of the pallet. Those hump portions are linked to form four elongate inboard composite humps 137 and one composite edge hump 149.

Each inboard composite hump 137 extends from one edge 121 of the pallet to an adjacent edge 121. Each inboard composite hump 137 extends over two tunnels 115, over the central panel 112 and across two edge panels 118. Each inboard composite hump 137 bends through a 90° curve at its centre 182 on the central panel 112.

The edge hump 149 extends around the full perimeter of the pallet, passing over each end of each tunnel, along the outboard edge 136 of each edge panel 118 and along both outboard edges 135 of each corner panel 119.

Where each inboard hump 137 passes over a tunnel 115, one inboard buttress **152*b* links each tunnel-top hump portion 150*b* to a respective central hump portion 140 and another inboard buttress 152*b* links each tunnel-top hump portion 150*b* to the respective central hump portion 140**.

The edge buttresses **152*a* and tunnel-top hump portions 150*a* of the composite edge hump 149 differ from the inboard buttresses 152*b* and tunnel-top hump portions 150*b* of the central hump portions 140. For the central hump portions 140, the top 155 of each inboard buttress 152*b* extends in an arch up to above the height of the upper face 151*b* of the associated inboard tunnel-top hump portion 150*b*. For the composite edge humps 149 the upper face 151*a* of the edge tunnel-top hump portions 150*a* is raised higher than for inboard tunnel-top hump portions 150*b* to provide increased resistance to flattening of the tunnels at the edges 121** when under load.

A curved bend portion 184 of the hump 137 provides the 90° curve at the centre 182 of the inboard composite hump 137.

The open bottoms 153 and 154 on the tunnels 115 and buttresses 152 permit the pallets 110 to nest into each other when stacked as shown in FIGS. 11 to 13. Nested pallets are prevented from jamming together by the configuration of eight of the buttresses 152. The eight buttresses in that selection are referred to herein as support buttresses 156.

While the lower portion of the upper faces of most of the buttresses are curved to blend smoothly into the upper faces of the abutting hump portions, the lower portion of the support buttresses 156 incorporate a step 164 having a horizontal platform portion 166 which ends at an end wall portion 168 which drops to the associated hump portion. The step 164 has the same configuration and general function as step 64 described above.

The step 164 is a relatively thin walled moulded hollow portion formed integrally with the remainder of the pallet. Within the hollow (ie on the underside of) each step 164 is a rib 170 having the form of a vertically aligned planar web extending down from the undersurface of the step 164, and extending from side wall to side wall of the support buttress 156 and approximately centrally to the step 164. The bottom edge 171 of the rib 170 is aligned with the lower surface of the adjacent portion of respective panels. As can be seen particularly in the cutaway portion of FIG. 13, when such pallets are stacked upon each other, the bottom edge 171 of each rib 170 bears against the upper surface of a step 164 on the underlying pallet, so successively underlying ribs 170 form a structural column wherein a load is transferred to the corresponding rib 170 below. This means that when pallets 110 are stacked in a nested configuration on each other on a floor and a load is placed on the upper pallet, the weight of that load is transmitted at least in part through to the floor by way of the column of vertically aligned ribs 170.

All the support buttresses 156 are buttresses which rise against the walls of one of the pairs of tunnels. The other pair of tunnels is not directly associated with any support buttresses. Four of the support buttresses **156*a* have their step positioned on a respective corner panel, whereas the other four support buttresses 156***b* have their step positioned on the central panel 112.

The horizontal portions of the central panel 112, edge panels 118 and corner panels 119 respectively and the upper walls of the tunnels are each formed as an open square lattice in the manner described above for pallet 10 in FIG. 1. A pallet 110 as described weighs approximately 3.3 kg when the wall thickness for all parts is nominally 2.5 mm. The wall thickness is preferably in the range 2.0 to 3.0 mm.

In a further embodiment (not illustrated) which is a modification of pallet 110, each composite hump 137 continues straight across the central panel 112 instead of turning through the 90° curve.

Whilst the above description includes the preferred embodiments of the invention, it is to be understood that many variations, alterations, modifications and/or additions may be introduced into the constructions and arrangements of parts previously described without departing from the essential features or the spirit or ambit of the invention.

It will be also understood that where the word "comprise", and variations such as "comprises" and "comprising", are used in this specification, unless the context requires otherwise such use is intended to imply the inclusion of a stated feature or features but is not to be taken as excluding the presence of other feature or features.

It will be also understood that where the term "inboard edge" is used in this specification, it is intended to refer to an edge of a feature which does not run along an outside edge (that is, on the perimeter) of the pallet. Similarly where the term "inboard end" is used in this specification, it is intended to refer to an end of a feature which is not at an outside edge (that is, not on the perimeter) of the pallet.

It will be also understood that where the term "open" is used in this specification in relation to the "inverted open channel shape" of the tunnels adapted to accept the forklift tines, that term is intended to mean that no portion of the pallet extends across the longitudinal opening defined by that channel.

The reference to any prior art in this specification is not, and should not be taken as, an acknowledgment or any form of suggestion that such prior art forms part of the common general knowledge.

What is claimed is:

1. A pallet moulded from plastics material and adapted for supporting a flexible intermediate bulk container on a top surface of the pallet and lifting the container with tines engaging a bottom surface of the pallet, said container being of the type that yields and deforms when subjected to an external force, and which deforms and conforms substantially to the contours of the top surface of the pallet when placed upon the pallet, said pallet comprising:

a generally planar central panel portion;

a pair of parallel inverted open channels extending across the pallet and rising upwards from the plane of the central panel portion to form a respective pair of open-ended tunnels configured to receive tines of a forklift, each said tunnel having a generally planar upper wall and two side walls and each tunnel extending fully between two opposite ends of the pallet; and a pair of edge panel portions generally co-planar with said central panel;

each said tunnel having:

a first of said side walls adjoining a corresponding inboard edge of said central panel, and the second of said side walls adjoining an inboard edge of a corresponding said edge panel;

wherein:

at least the planar central portion is located within the pallet so that it sits substantially coplanar with a bottom of the pallet;

an array of raised elongate first hump portions bulges upwards from each said upper wall of the tunnels, each said first hump portion extending laterally across a respective said upper wall;

a first end of each said first hump portion abuts a first end of a respective first buttress which extends up said first side wall; and a second end of each said first hump portion abuts a first end of a respective second buttress which extends up said second side wall.

2. The pallet according to claim 1 wherein a first selection of said buttresses rise above the height of their abutting said first hump portions.

3. The pallet according to claim 2 wherein a second selection of said first hump portion and associated said first buttress and said second buttress are located at each end of each said tunnel, and said first hump portions in said second selection rise to substantially the same height as the buttresses in said second selection.

4. The pallet according to claim 1 wherein an array of raised elongate second hump portions is moulded into each said edge panel, each said second hump portion extends from a said inboard edge of said edge panel to an outer edge of said edge panel, and transverse to the longitudinal direction of said tunnels, and each said second buttress abuts an end of a respective said second hump portion.

5. A pallet moulded from plastics material and adapted for supporting a flexible intermediate bulk container on a top surface of the pallet and lifting the container with tines engaging a bottom surface of the pallet, said container being of the type that yields and deforms when subjected to an external force, and which deforms and conforms substantially to the contours of a top surface of the pallet when said container it is placed on the pallet, said pallet comprising:

a generally planar central panel portion;

a pair of parallel inverted open channels extending across the pallet and rising upwards from the plane of the central panel portion to form a respective pair of tunnels configured to receive tines of a forklift, each said tunnel having a generally planar upper wall and two side walls; and a pair of edge panel portions generally co-planar with said central panel;

each said tunnel having:

a first of said side walls adjoining a corresponding inboard edge of said central panel, and the second of said side walls adjoining an inboard edge of a corresponding said edge panel;

wherein:

at least the generally planar central portion is located within the pallet so that it sits substantially coplanar with a bottom of the pallet;

an array of raised elongate first hump portions bulges upwards from each said upper wall of the tunnels, each said first hump portion extending laterally across a respective said upper wall;

an array of raised elongate second hump portions bulges upwards from each said edge panel, each said second hump portion extending longitudinally from a said inboard edge of said edge panel to an outer edge of said edge panel, and extending transverse to the longitudinal direction of said tunnels;

an array of raised elongate third hump portions bulges upwards from said central panel, each said third hump portion extending longitudinally from one said inboard edge of the central panel to the other said inboard edge of the central panel, and extending transverse to the longitudinal direction of said tunnels;

each end of each said third hump portion is linked to its respective said tunnel by a first buttress which extends up a said first side wall to where the first buttress links to a corresponding said first hump portion; and an inboard end of each said second reinforcing hump is linked to its respective said tunnel by a second buttress which extends up a said second side wall to where the second buttress links to a corresponding said first hump portion.

6. A pallet moulded from plastics material and adapted for supporting a flexible intermediate bulk container on a top surface of the pallet and lifting the container with tines engaging a bottom surface of the pallet, said pallet comprising:

a generally planar central panel portion;

a first pair of parallel inverted open channels extending across the pallet in a first direction and rising upwards from the plane of said central panel portion to form a respective first pair of tunnels configured to receive tines of a forklift;

a second pair of parallel inverted open channels extending across the pallet in a second direction at right angles to said first direction and rising upwards from said plane of said central panel portion to form a respective second pair of tunnels configured to receive tines of a forklift; and two pairs of edge panel portions generally co-planar with said central panel portion;

each said tunnel having:

a generally planar upper wall and two side walls, a first of said side walls adjoining a corresponding inboard edge of said central panel, and a second of said side walls adjoining an inboard edge of a corresponding said edge panel;

wherein:

at least the generally planar central portion is located within the pallet so that it sits substantially coplanar with a bottom of the pallet;

a first array of raised elongate first reinforcing humps bulges upwards from said central panel, each said first hump extending longitudinally from one said inboard edge of the central panel to the other said inboard edge of the central panel;

a second array of raised elongate second reinforcing humps bulges upwards from each said edge panel, each said second reinforcing hump extending longitudinally from a said inboard edge of said edge panel to an outer edge of the edge panel, and extending transverse to the longitudinal direction of said tunnels;

a third array of raised elongate third reinforcing humps bulges upwards from each said upper wall of the tunnels, each said third hump extending laterally across a respective said upper wall;

each end of each said first reinforcing hump is linked to its respective said tunnel by a first buttress which extends up a first said side wall to a corresponding said third reinforcing hump; and an inboard end of each said second reinforcing hump is linked to its respective said tunnel by a second buttress which extends up a second said side wall to a corresponding said third reinforcing hump.

7. The pallet according to claim 6 wherein said buttresses are hollow and fully open along their length to the underside of the pallet.

8. The pallet according to claim 7 wherein the nominal wall thicknesses of the plastics material in the central panel portion, the edge panel portions and the tunnels differ by no more than 50% of their smallest nominal thickness.

9. The pallet according to claim 8 wherein all the nominal wall thicknesses of the plastics material in the central panel, the edge panels and the tunnels are substantially the same.

10. The pallet according to claim 7 which is stackable in a nested stack of identical pallets wherein the addition of each said pallet to the stack increases the height of the stack by no more than 30% of the height of a freestanding individual said pallet.

11. The pallet according to claim 10 wherein the addition of each said pallet to the stack increases the height of the stack by about 25% of the height of a freestanding individual said pallet.

12. The pallet according to claim 11 wherein a plurality of said buttresses each incorporate a step comprising a substantially horizontal platform, each step providing an engagement means which extends to level with the lower surface of the adjacent portion of the respective central panel or edge panel whereby, when like said panels are stacked nested together, load from an upper said pallet may be transmitted through the engagement means of said upper pallet to the underlying platform of a said pallet nested immediately below said upper pallet.

13. The pallet according to claim 12 wherein each said step is hollow except for a rib which extends across the buttress and from the underside of said platform to level with the lower surface of the adjacent portion of the respective central panel or edge panel whereby, when like said panels are nested together, load from an upper said pallet may be transmitted through the web of the upper pallet to the underlying platform of said pallet nested immediately below said upper pallet.

14. The pallet according to claim 7 wherein:

a corner panel is provided in each corner of the pallet, said corner panels being generally co-planar with the central panel, a raised elongate fourth reinforcing humps bulges upwards at the outer edge of each said edge panel, a raised curved fifth reinforcing humps bulges upwards of each corner panel, and said elongate reinforcing humps and buttresses are connected to such that each end of each said reinforcing hump is linked to its respective said tunnel by a buttress which extends up the side wall to a corresponding reinforcing hump and provides a continuous reinforcing hump around the pallet's perimeter.

15. The pallet according to claim 14 wherein each said second buttresses is connected to said continuous reinforcing hump by a respective hump in said second array.

16. The method of transporting a flexible intermediate bulk container at least substantially filled with bulk material, said method comprising placing the container on a pallet according to claim 7, engaging the tines of a forklift apparatus with said tunnels and lifting the pallet by raising the forklift tines.

17. The pallet according to claim 1 wherein said buttresses are hollow and fully open along their length to the underside of the pallet.

* * * * *